US006478604B1

(12) United States Patent
Downes et al.

(10) Patent No.: US 6,478,604 B1
(45) Date of Patent: Nov. 12, 2002

(54) METHODS AND APPARATUS FOR FORMING AN INSULATION DISPLACEMENT CONNECTION

(75) Inventors: Stuart D. Downes, Milford, MA (US); Timothy M. Mulvihill, Lakeville, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 09/879,269

(22) Filed: Jun. 12, 2001

(51) Int. Cl.[7] ..... H01R 11/20

(52) U.S. Cl. ..... 439/400; 439/395; 439/396; 439/399

(58) Field of Search ..... 439/395, 396, 439/399, 400, 404, 931, 398

(56) References Cited

U.S. PATENT DOCUMENTS 5,911,593 A * 6/1999 Glaser et al. ..... 439/395
6,132,237 A * 10/2000 Hwang ..... 439/395
6,203,360 B1 * 3/2001 Harting et al. ..... 439/395

FOREIGN PATENT DOCUMENTS

JP 2-78164 * 3/1990 ..... 439/395

* cited by examiner

*Primary Examiner*—Tho D. Ta
(74) *Attorney, Agent, or Firm*—Chapin & Huang, L.L.C.; David E. Huang, Esq.

(57) ABSTRACT

A ribbon cable assembly includes a segment of ribbon cable having first and second ends, a first IDC connector mounted to the first end of the ribbon cable segment, and a second IDC connector mounted to the second end of the ribbon cable segment. Each connector includes a connector housing, and a set of terminals supported by the connector housing. Each terminal has a base portion (e.g., a pin, a pad, etc.) for coupling to an external device, and a cable attachment portion which is unitary with the base portion of that terminal. The cable attachment portion of each terminal defines (i) a slot that receives a wire, and (ii) wire positioners that position the wire within the slot when the slot receives the wire. The wire positioners of each terminal can precisely locate a wire within that terminal. The wire positioners facilitate wire retention and improve electrical connectivity thus providing a reliable electrical pathway between the wire and that terminal.

23 Claims, 9 Drawing Sheets

METHODS AND APPARATUS FOR FORMING AN INSULATION DISPLACEMENT CONNECTION

BACKGROUND OF THE INVENTION

A typical ribbon cable assembly includes a portion of ribbon cable and a connector fastened at each end. The portion of ribbon cable is generally flat and thin, and includes multiple wire segments which extend in a parallel. Such a ribbon cable assembly can provide many electrical connections between a pair of electronic components (e.g., between a disk drive and a disk drive controller) in a well-organized and efficient manner.

Typically, each wire segment (or simply wire) of the ribbon cable portion includes a conductor and insulation which surrounds that conductor. In some ribbon cables, the conductor of each wire is a single solid strand. In other ribbon cables, the conductor of each wire includes multiple strands (e.g., seven) which are wound in a helix.

Each connector of the ribbon cable assembly typically includes a connector housing, and multiple metallic wire terminals which connect with the wire segments of the ribbon cable portion and which are held in place by the connector housing. The terminals are typically arranged in one or more rows.

Some terminals are configured to form insulation displacement connections (IDCs) with ribbon cable wires. One conventional IDC terminal includes a pair of metal tines at one end and a pin at the other end. The pair of tines define a rectangular-shaped slot, i.e., a slot having parallel edges, for receiving a wire. The comers of the slot (i.e., where the tines attach to the remaining portion of the IDC terminal) are typically coined (rather than sharply cut at 90 degrees) in order to prevent the tines from breaking off and to avoid creating stamping burrs that could sever the wire. When a wire inserts into the rectangular-shaped slot, the tines pierces the insulation around the wire in order to expose the conductor. As the wire further inserts into the rectangular-shaped slot, the tines push away some of the insulation and make direct contact with the conductor (e.g., metal-to-metal). The displaced insulation provides mechanical support to interference fit the wire within the rectangular-shaped slot. Furthermore, the tines provide a squeezing force that holds the wire within the rectangular-shaped slot.

It should be understood that the force provided by the tines against the wire gradually increases as the wire moves further into the rectangular-shaped slot. Although the force provided by the tines is greatest at their attachment points and weakest at the distal ends of the tines, final placement of the wire within the IDC terminal can occur anywhere within the slot. Manufacturers typically try to avoid placement of the wire at the bottom of the slot since such placement would risk inadvertently cutting the wire because the tines are rigid and no longer behave elastically at that point.

Automated machinery can install ribbon cable portions onto the connectors. In one approach, an arm presses (or stamps) the end of a ribbon cable portion onto a row of IDC terminals of a connector. As mentioned above, as each wire inserts into a corresponding IDC terminal, the tines of that terminal cut away insulation on that wire and contact the conductor of that wire. The pair of tines provide a squeezing force in order to hold the wire and provide an electrical pathway between the terminal and the wire. In some situations, the aggregate retention force between the IDC terminals and the ribbon cable wires is sufficient to retain the portion of ribbon cable within the connector. In other situations, the connectors further include a strain relief member (e.g., a clamp) that physically fastens to the portion of ribbon cable to prevent the ribbon cable portion from disconnecting from the connector.

SUMMARY OF THE INVENTION

Unfortunately, there are deficiencies to the above-described conventional ribbon cable assembly. In particular, the amount of electrical connectivity between a ribbon cable wire and its corresponding IDC terminal can vary (e.g., can differ for a particular wire over time, can differ from wire to wire, etc.).

For example, suppose that the conductor of a wire installed within an IDC terminal includes a bundle of strands which are twisted into a helix. Immediately after installation of the wire within the IDC terminal, the end of the conductor (i.e., the wire tail) may still retain much of its helix shape and make adequate electrical contact with the IDC terminal. However, over time subtle movements of the wire (e.g., due to normal handling and flexing of the ribbon cable assembly, vibration from neighboring equipment, changes due to temperature cycles/variations, etc.) can cause the strands of the wire to unravel. That is, some strands may stray from the bundle resulting in a fragmentation or loss of material in the main wire bundle at the contact area. Such separations reduce both the mechanical compression and electrical contact area. In this situation, there is less pressure between the remaining bundle and the tines thus lowering electrical connectivity between the wire and the IDC terminal. In some situations, the bundle may completely unravel from its helix shape leaving the wire with minimal or no electrical contact with the IDC terminal.

As another example, suppose that the conductor of a wire installed within an IDC terminal includes a single solid strand. Since the slot is rectangular in shape, the single solid strand contacts the IDC terminal in exactly two places, i.e., one side of the solid strand contacts one tine, and the other side of the solid strand contacts the other tine. Over time, the tines may dig into and deform the solid strand so that pressure between the tines and the solid strand decreases thus lowering electrical connectivity. Also, in some situations, a portion of the displaced insulation may work its way between the conductor and a tine, and thus interfere with one of the two contact points thus reducing electrical connectivity.

Such lowered electrical connectivity between the conductor and the IDC terminal can result in unreliable electrical pathways between electronic components which communicate through the ribbon cable assembly. In some situations, such pathways could provide intermittent electrical connections resulting in corrupted or lost data, excessive read or write errors (i.e., signal errors) requiring repeated read and write operations or, even worse, a failed connection that prevents the components from properly communicating all together.

In contrast to the above-described conventional ribbon cable assembly, the invention is directed to techniques for forming an insulation displacement connection using a terminal that defines wire positioners which can locate a wire within the terminal. The wire positioners facilitate wire retention and improve electrical connectivity thus providing a reliable electrical pathway between the wire and the terminal.

One arrangement of the invention is directed to a ribbon cable assembly which includes a segment of ribbon cable having first and second ends, a first IDC connector mounted to the first end of the ribbon cable segment, and a second IDC connector mounted to the second end of the ribbon cable segment. Each connector includes a connector housing, and a set of terminals supported by the connector housing. Each terminal has a base portion (e.g., a pin, a pad, etc.) for coupling to an external device, and a cable attachment portion which is unitary with the base portion of that terminal. The cable attachment portion of each terminal defines (i) a slot that receives a wire, and (ii) wire positioners that position the wire within the slot when the slot receives the wire. The wire positioners can position the wire such that it is held in an optimal location within the slot, i.e., a "sweet spot" of the terminal for improved electrical connectivity.

In one arrangement, the cable attachment portion of each terminal includes a pair of jaws. Each wire positioner (e.g., a metallic bump) defined by the cable attachment portion of that terminal extends from a central region of a jaw toward a midline of the slot. Accordingly, the wire positioners can make electrical contact with the conductor of the wire to improve electrical connectivity. For example, if the conductor is a single solid strand, the wire positioners can provide additional points of contact with the conductor for better electrical connection (e.g., four points of contact rather than two points of contact as in the earlier-described conventional approach).

In one arrangement, the cable attachment portion of each terminal is configured to retain a wire having multiple strands (e.g., seven strands of 38 AWG wire), each strand having a diameter N (e.g., 0.00397 inches). In this arrangement, the cable attachment portion of each terminal preferably defines a gap between the wire positioners that is substantially half of the diameter N. Accordingly, strands of the wire will be unable to pass through the wire positioners and thus unable to stray from the bundle of strands further into the slot. As a result, the terminal constrains the bundle and sustains reliable electrical contact with the wire.

In one arrangement, the cable attachment portion of each terminal defines a substantially circular opening at a centrally disposed end of the slot defined by the cable attachment portion of that terminal. The substantially circular opening preferably has a diameter which is greater than a maximum width of the slot defined by the cable attachment portion of that terminal. Accordingly, parts (e.g., jaws) of the cable attachment portion can hinge at the circular opening. The hinging operation of the cable attachment portion, in combination with the operation of the wire positioners to precisely locate the wire, provides more consistent wire retention results (e.g., consistent pressure on the conductor) vis-a-vis the above-described conventional IDC terminal which provides a force which increases as the wire moves further down and into the slot and thus varies depending on how much the wire drifts (e.g., over time) within the slot of the conventional IDC terminal.

In one arrangement, the cable attachment portion of each terminal includes a pair of jaws that defines a portion of the slot such that the width of that portion of the slot narrows in a direction from a central location of the cable attachment portion toward an end of the cable attachment portion. Accordingly, the wire is prevented from moving (e.g., creeping) back up the slot. Additionally, if the wire includes a multi-stranded conductor, individual strands are constrained rather than allowed to unravel in a direction back up the slot thus preserving the wire bundle and sustaining the pressure between the wire bundle and the cable attachment portion of the terminal.

In one arrangement, ribbon cable assembly further includes a high-conductive metallic coating (e.g., gold, bronze, tin, lead, etc.) disposed over portions of the cable attachment portion of each terminal which define the wire positioners. The coating can improve electrical conductivity, prevent corrosion, etc. The location and amount of the coating can be controlled to avoid wasting the coating material over the entire terminal, i.e., to avoid placing the coating over terminal locations that are not intended for contact with the wire conductor.

The features of the invention, as described above, may be employed in connection systems, devices and methods and other computer-related components such as those provided by EMC Corporation of Hopkinton, Mass.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The invention is directed to techniques for forming an insulation displacement connection (IDC) using a terminal that defines wire positioners which can precisely locate a wire within the terminal. The wire positioners can operate as wire stops to facilitate wire retention and to improve electrical connectivity thus providing a reliable electrical pathway between the wire and the terminal.

Figure 1:
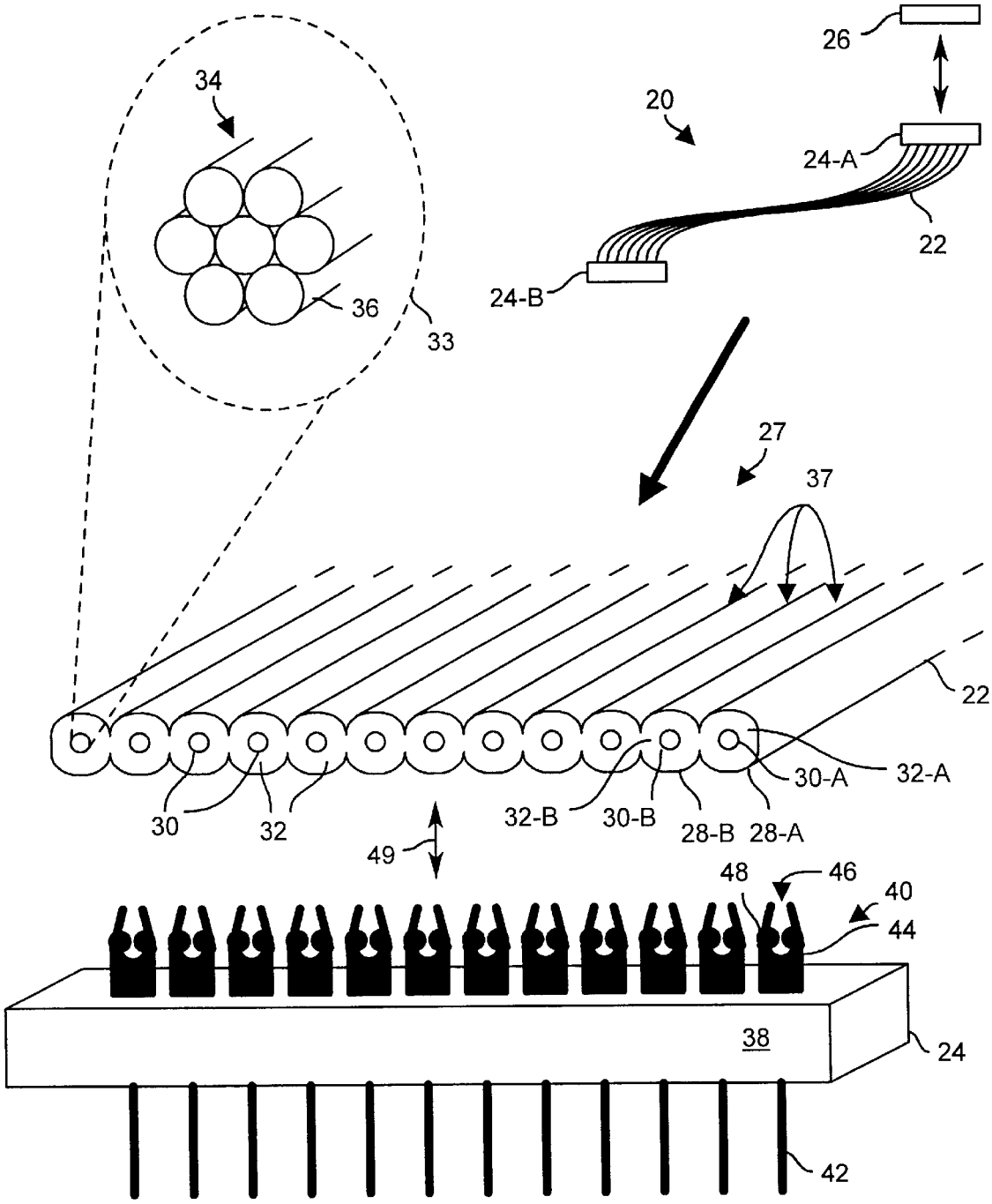
FIG. 1 is a diagram of a ribbon cable assembly which is suitable for use by the invention.

FIG. 1 shows a ribbon cable assembly 20 which is suitable for use by the invention. The ribbon cable assembly 20 includes a portion of ribbon cable 22, and IDC connectors 24-A, 24-B (collectively, connectors 24). Each IDC connector 24 is capable of connecting to an external device 26 (e.g., an external connector, a circuit board, a backplane, etc.).

As shown in a more detailed view 27 of FIG. 1, the ribbon cable portion 22 (or simply ribbon cable 22) includes parallel wires 28-A, 28-B, . . . (collectively, wires 28), arranged in a flat, thin, flexible configuration. Each wire 28 (e.g., wire 28-A) includes a conductor 30 (e.g., conductor 30-A) and insulation 32 (e.g., insulation 32-A). In one arrangement, each conductor 30 is a single, solid metal strand (e.g., copper, aluminum, etc.). In another arrangement, each conductor 30 includes multiple strands. For example, as shown in the view 33 of FIG. 1, each conductor 30 can include a bundle 34 of strands 36 which are twisted together in a helical manner. For simplicity, the helix angle (a metric indicative of the number of revolutions per linear inch of wire) is not shown in FIG. 1.

During installation of the ribbon cable 22 onto a connector 24, the insulation 32 (e.g., laminate, PVC, etc.) is pierced at zones 37 where the wires 28 attach to each other. As will be described in further detail later, such zones 37 can be pre-cut by machinery which installs the ribbon cable 22 onto the connector 24, or cut by the connector 24 itself.

Each connector 24 includes a connector housing 38 and a set of IDC terminals 40 which fasten to the connector housing 38. By way of example only, the connector housing 38 arranges the terminals 40 a single row. In other arrangements, the connector housing 38 arranges the terminals 40 differently, e.g., in multiple rows.

Each IDC terminal 40 includes a base portion 42, and a cable attachment portion 44 which defines a slot 46 for receiving a wire 28, and a set of wire positioners 48 for positioning that wire 28 within that slot 46. The wire positioners 48 identify the locations for the wires within the slots 46. The spacing of the terminals 40 corresponds to the spacing of the wires 28 in the ribbon cable portion 22. Accordingly, the ribbon cable portion 22 can be installed onto the connector 24 such that each wire 28 installs within the slot 46 of a corresponding terminal 40. The terminals 40 can be manufactured using a stamping process (e.g., progressive die work on metal sheets), etching, plating and/or combinations thereof. That is, the metal can be formed into a ribbon and wound onto spools. The ribbon stock (i.e., sheet stock) can then be fed through the progressive dies. Further details of the invention will now be provided with reference to FIG. 2.

Figure 2:
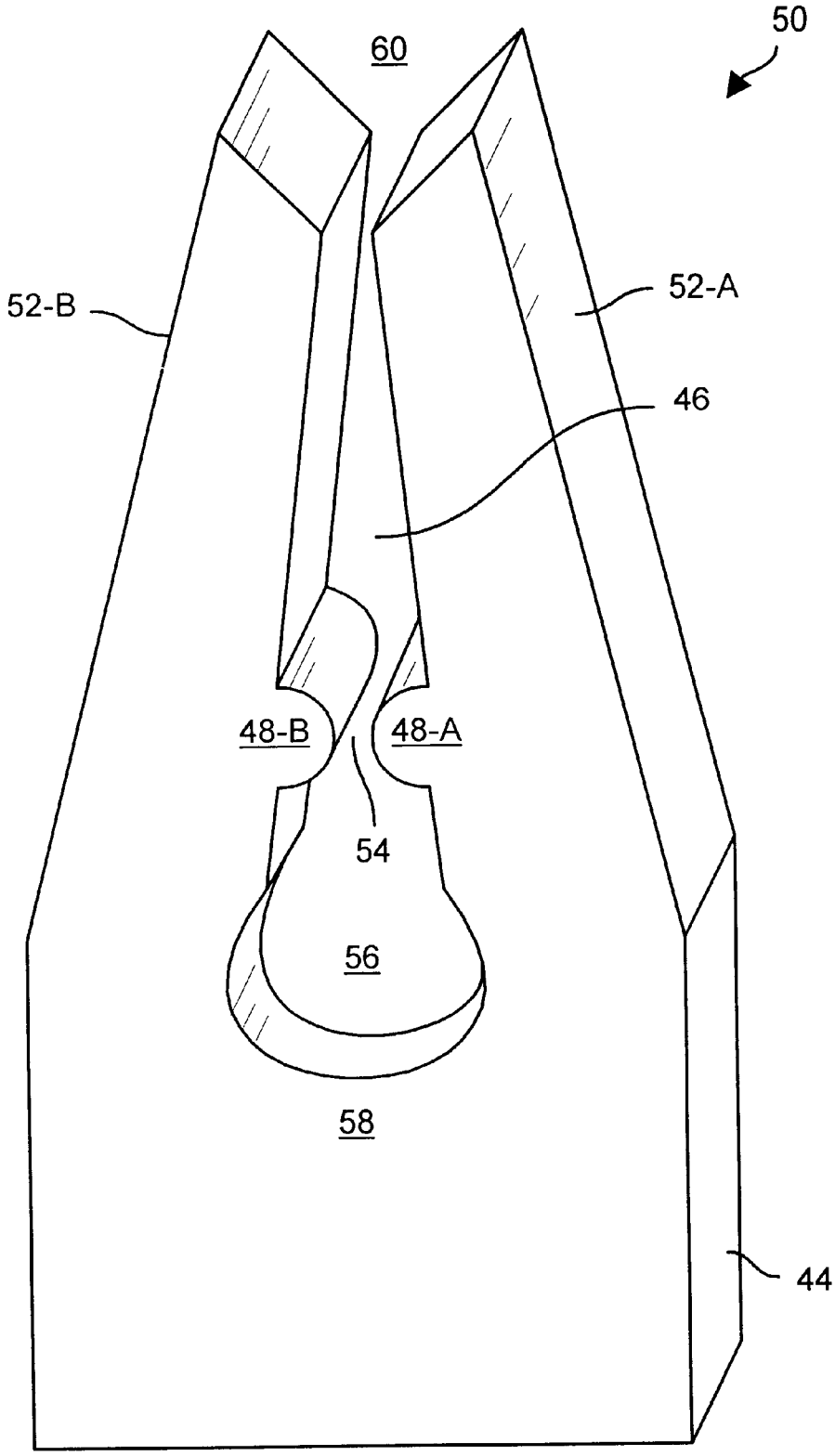
FIG. 2 is a perspective view of a cable attachment portion of an insulation displacement connection terminal of the ribbon cable assembly of FIG. 1.

FIG. 2 shows a perspective view 50 of the cable attachment portion 44 (i.e., a connector tail portion) of a terminal 40. The cable attachment portion 44 defines a pair of jaws 52-A, 52-B (collectively, jaws 52). The jaws 52 extend outwardly to an end location 60 and define at least a portion of the slot 46 as well as the wire positioners 48 (e.g., bumps 48-A, 48-B). As shown in FIG. 2, the jaws 52 are slightly closed at the end 60.

The cable attachment portion 44 further defines a substantially circular opening 56 having a diameter which is greater than a maximum width of the slot 46. The opening 56 operates as a strain relief which enables the jaws 52 to operate in a hinged-like manner relative to a lower portion 58 of the cable attachment portion 44. That is, this arrangement provides a compliant hinge mechanism during the wire insertion and clamp operation. As further shown in FIG. 2, the jaws 52 at the terminal end 60 are preferably tapered to facilitate opening of the cable attachment portion 44 either by a wire 28 or by a separate external device, i.e., the ends of the jaws 52 have a compound feed angle that enables a tool to spread the jaws apart during wire installation. Preferably, the jaws are spread apart to the parallel position (i.e., such that the sides of the slot are temporarily parallel). The jaws should not be opened well beyond parallel since that would result in random and inefficient displacement of insulation. In one arrangement, the jaws are rounded (i.e., have radii) rather than a flat surface in order to facilitate opening by the wire 28 or a separate tool.

In one arrangement, the terminal 40 is designed to form an insulation displacement connection with a wire 28 having a conductor 30 which includes multiple strands 36 (e.g., seven strands of 38 AWG wire). In this arrangement, the cable attachment portion 44 preferably defines a gap 54 (i.e., a slot width) between the wire positioners 48 that is substantially equal to half of the diameter (e.g., 0.00397 inches) of a strand 36. Accordingly, the wire positioners 48 constrain the strands 36 of that wire 28 thus preventing the strands from creeping or straying further into the slot 46. Such constraint keeps each strand 36 as a supported and compressed member of the bundle 34 (also see FIG. 1).

In other arrangements, the gap 54 is not substantially equal to half a strand diameter. In these other arrangements, the width of the gap 54 is dictated by mechanical and geometric considerations such as the number of conductor strands 36, the twist or helix angles of the strands 36 (i.e., the tightness of the wire helix), the ductility and types of metal in the conductor 30 (i.e., the softness of the wire conductor), the strand diameter, and so on. Not only do such aspects have a bearing on the compliant jaw gap, such aspects also have a bearing on determining the relaxed mechanical interference holding force of the jaws 52. Further details of the invention will now be provided with reference to FIG. 3.

Figure 3:
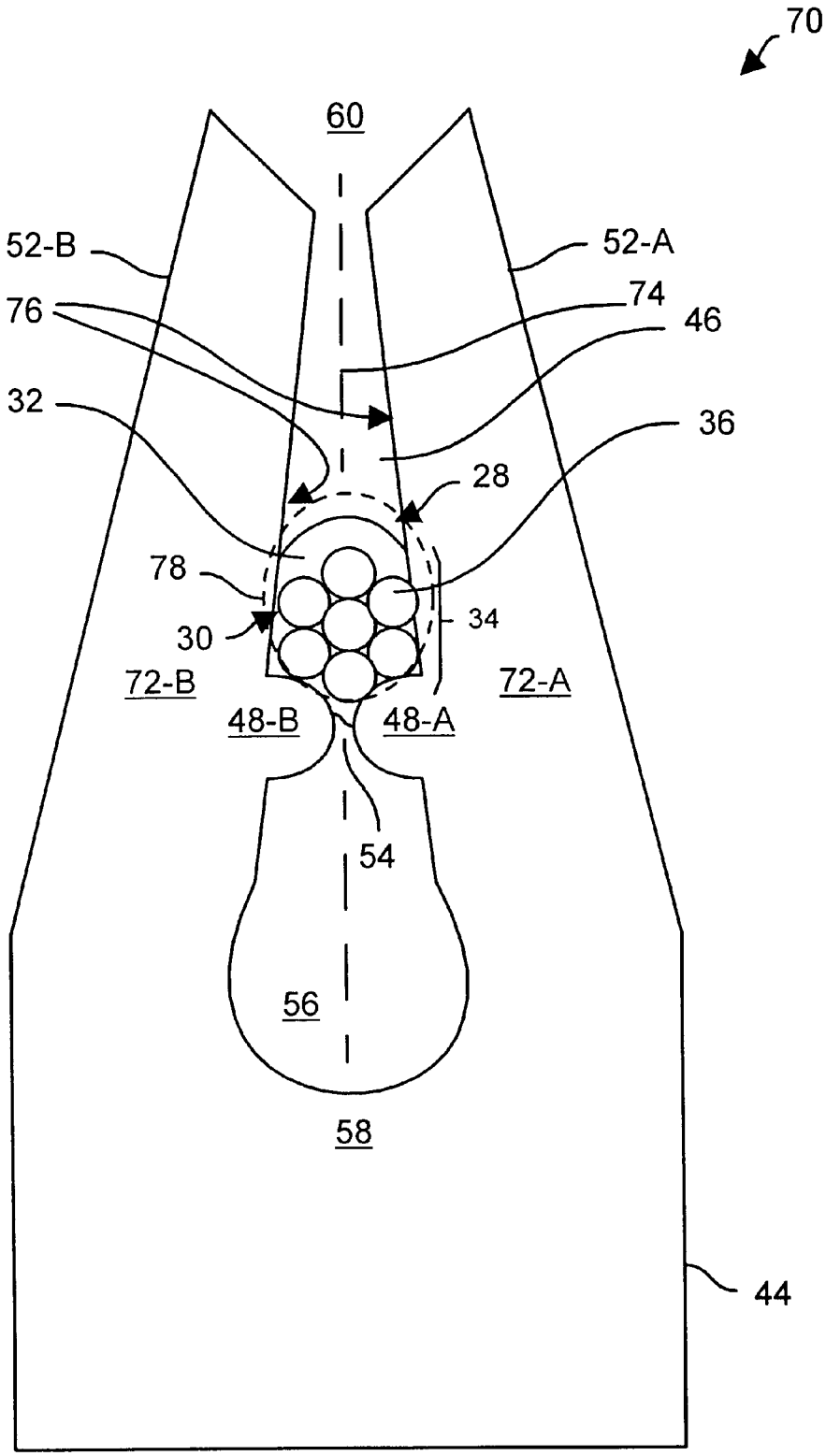
FIG. 3 is a side view of the cable attachment portion of FIG. 2 when a wire is positioned within a slot defined by the cable attachment portion of FIG. 2.

FIG. 3 shows a side view 70 of the cable attachment portion 44 of an IDC terminal 40. As shown, each wire positioner 48 extends from a central region 72 of a jaw 52 toward a midline 74 of the slot 46 (e.g., the wire positioner 48-A extends from the central region 72-A of the jaw 52-A toward the midline 74). When a wire 28 is installed into the slot 46 of the cable attachment portion 44, the sides 76 of the jaws 52 cut through (i.e., pierce) and displace insulation 32 of the wire 28 to expose the conductor 30 of the wire. The sides 76 then make direct contact with the exposed conductor 30. As shown in FIG. 3 by way of example only, the conductor 30 is a bundle 34 of strands 36. The sides 76 of the jaws 52 are in direct metal-to-metal contact with the bundle 34 of strands 36.

It should be understood that the jaws 52 and the wire positioners 48 define a "sweet spot 78" within the slot 46. The sweet spot 78 is an optimal location for the wire 28. In particular, at the sweet spot 78, the jaws 52 provide a predetermined and controlled amount of force (within a compliant range) toward the midline 74 for solid electrical contact but not to a degree that damages (e.g., severely cuts) the wire conductor 30. Additionally, the jaws 52 and the wire positioners 48 provide multiple points of contact with the conductor 30 of the wire 28. Furthermore, the design of the jaws 52 and wire positioners 48 provides a symmetrical and diametrically centered wire 28 (i.e., wire conductor 30). For these reason (among others), the cable attachment portions 44 of the terminals 40 provide high electrical connectivity with the wires 28 of the portion ribbon cable 22.

Preferably, the sweet spot 78 is not too near to the hinging locations of the jaws 52 since the clamping pressure is less at these locations. Furthermore, the end portions of the jaws 52 above the sweet spot 78 are preferably long enough to consistently and effectively displace the wire insulation. Accordingly, the location of the sweet spot 78 preferably strikes a balance between these requirements, i.e., far enough from the strain relief opening for adequate clamping pressure and far enough from the jaw ends to enable the jaws 52 to consistently displace the insulation.

It should be further understood that the jaws 52 define the slot 46 such that the width of at least a portion of the slot 46 narrows in a direction from the central location 58 toward the end 60 of the cable attachment portion 44. Accordingly, the jaws 52 and the wire positioners 48 constrain the wire 28 within the sweet spot 78. As a result, the strands 36 of the bundle 34 tend to stay together (e.g., in a helixes) rather than stray or unravel. Preservation of the bundle 34 enables maintenance of a suitable force between the jaws 52 and the conductor 30 for proper electrical connectivity.

Additionally, it should be understood that the wire positioners 48 preferably are slightly rounded to provide a clearance area for displaced insulation. Accordingly, displaced insulation can enter this clearance area and effectively be removed from the electrical contact area. Further details of the invention will now be provided with reference to FIG. 4.

Figure 4:
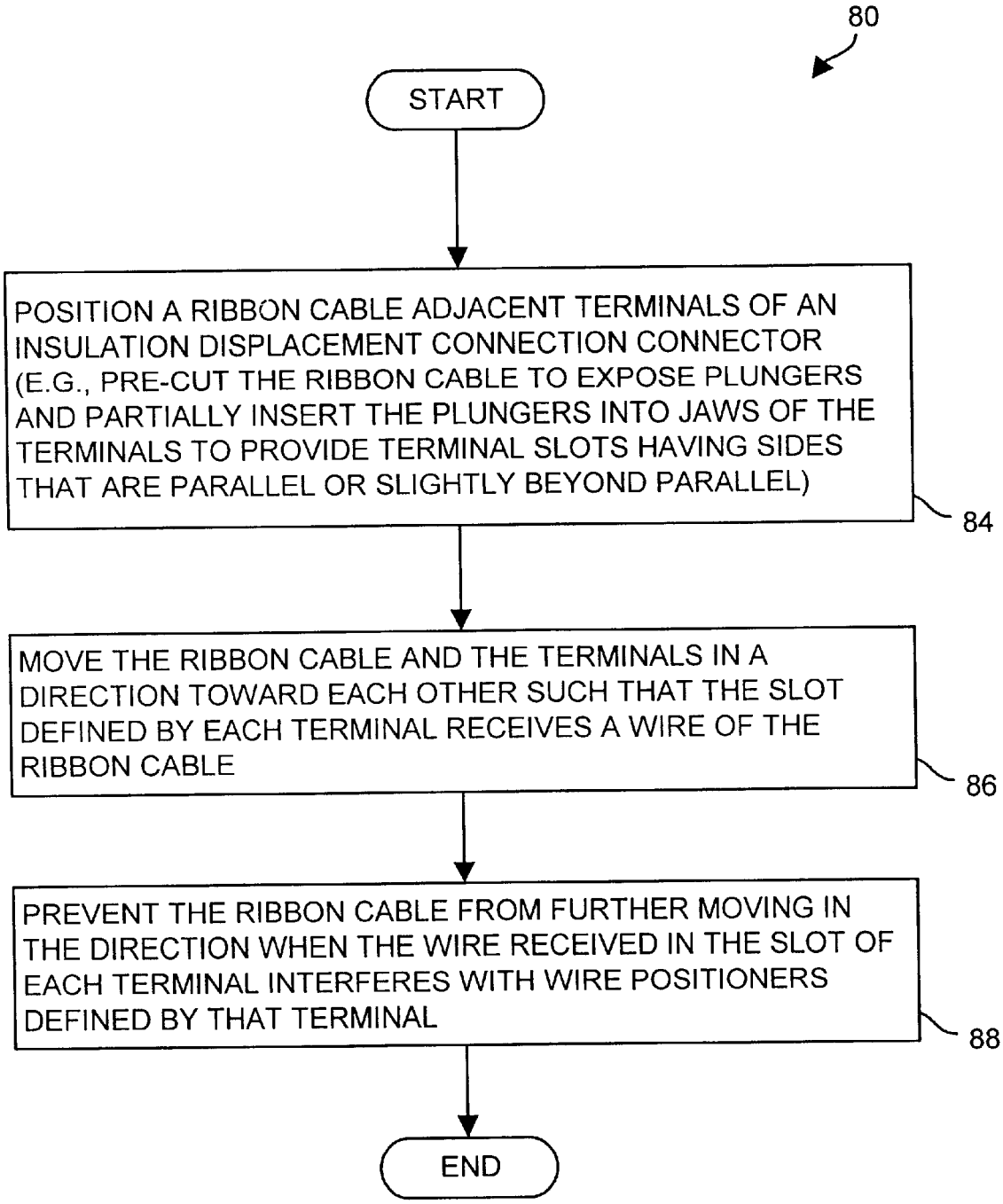
FIG. 4 is a flowchart of a procedure for installing a ribbon cable on an insulation displacement connection connector to form the ribbon cable assembly of FIG. 1.

FIG. 4 shows a procedure 80 for installing the ribbon cable portion 22 onto an IDC connector 24 (also see FIG. 1). The procedure 80 can be performed by either a person (e.g., a technician, and assembler, etc.), machinery (e.g., automated equipment), or a combination thereof. Further details of the procedure 80 are provided below with machinery performing particular steps by way of example only.

In step 84, the machinery positions the ribbon cable portion 22 adjacent to the terminals 40 of an IDC connector 24. In one arrangement, the machinery includes plungers (or spreader devices) which slightly open the jaws 52 to parallel (also see FIG. 3). Here, the machinery pre-cuts some of the insulation 32 of the ribbon cable portion 22 to expose the plungers thus enabling the plungers to contact and slightly open the jaws 52. Preferably, the plungers open the jaws 52 so that the slot no longer gets narrower from the lower portion 58 toward the end 60 (see FIG. 3). Rather, the plungers open the jaws 52 so that the sides 76 of the slot 46 are substantially parallel or slightly beyond parallel (i.e., open or wider toward the end 60).

In step 86, the machinery moves the ribbon cable 22 and the terminals 40 in a direction toward each other (see arrow 49 in FIG. 1) such that the slot 46 defined by each terminal 40 receives a wire 28 of the ribbon cable 22. As each wire 28 inserts into a corresponding terminal slot 46, insulation 32 of that wire 28 is displaced by the jaws 52 of the cable attachment portion 44 of the terminal 40 (also see FIG. 3) to expose the conductor 30 of that wire 28. In one arrangement, the connector 24 rests in a fixed location, and a machine arm pushes the ribbon cable 22 (e.g., down) onto the connector 24.

In step 88, the machinery prevents the ribbon cable 22 from moving further into the slot 46. The wire 28 stops at the wire positioners 48 of the terminal 40. At this point, the exposed conductor 30 makes direct contact with both the jaws 52 and the wire positioners 48 of the terminal 40.

The machinery then moves away from the connector 24 and the ribbon cable 22 thus allowing the jaws 52 to close around the wires 28 and provide constraint. That is, each wire 28 is prevented from moving further toward the connector housing 38 by the wire positioners 48, and prevented from moving away from the connector housing 38 and out of the slot 46 by the jaws 52 which narrow toward the end 60 of the terminal 40 (see FIG. 3).

Moreover, when the wire conductors 30 are bundles 34 of strands 36, the wire positioners 48 and narrowing jaws 52 constrain individual bundle strands 36 thus preserving the bundles 34 and enabling the jaws 52 to maintain adequate pressure against the conductors 30 for high electrical connectivity. When the wire conductors 30 are individual solid feeds, the wire positioners 48 and jaws 52 provide many contact points (e.g.,. four) for improved electrical connectivity of conventional IDC terminals having rectangular-shaped slots that provide only two points of contact. Further details of the invention will now be provided with reference to FIG. 5.

Figure 5:
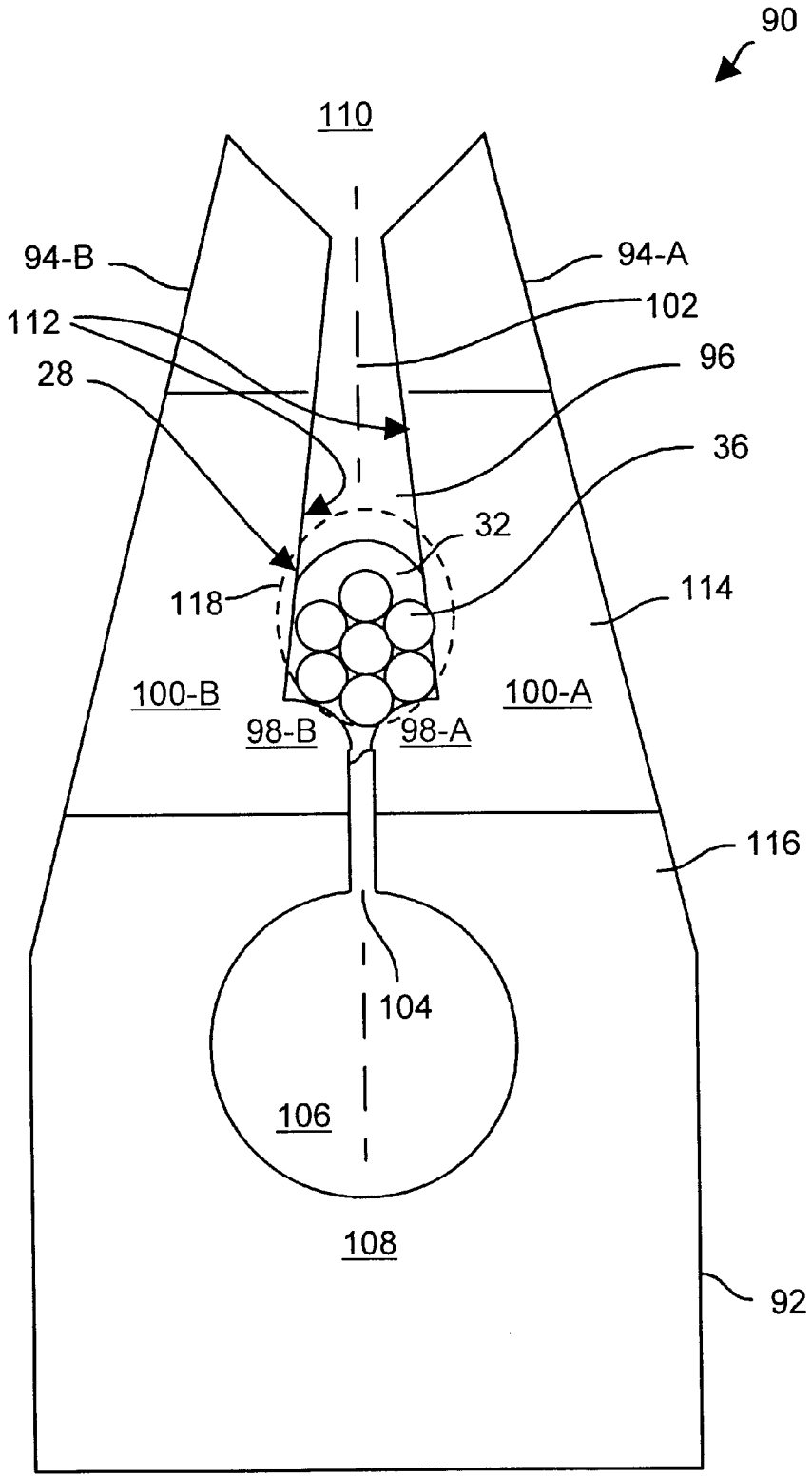
FIG. 5 is a side view of an alternative cable attachment portion which is suitable for use by the insulation displacement connection terminal of the ribbon cable assembly of FIG. 1.

FIG. 5 shows a side view 90 of an alternative cable attachment portion 92 for the terminals 40 of the ribbon cable assembly 20 (FIG. 1). The alternative cable attachment portion 92 is similar to the cable attachment portion 44 of FIG. 3 in that the cable attachment portion 92 includes (i) jaws 94-A, 94-B, which define a narrowing slot 96, and (ii) wire positioners 98-A, 98-B which extend from central regions 100-A, 100-B of the jaws 94-A, 94-B toward a midline 102 of the slot 96. Additionally, in the case of attaching to a stranded wire 28, the cable attachment portion 92 defines a gap 104 between the wire positioners 98 which, in some arrangements, is one half of the diameter of a strand 36.

However, in contrast to the cable attachment portion 44 (see FIG. 3), the wire positioners 98 of the cable attachment portion 92 (see FIG. 5) are not simply bumps along the sides of the jaws 94. Rather, the wire positioners 98 continue until they reach a substantially circular opening 106 adjacent a lower portion 108 of the cable attachment portion 92. The wire positioners 98 of the cable attachment portion 92 can include more material than the wire positioners 48 of the cable attachment portion 44 and thus provide manufacturability advantages over the cable attachment portion 44. That is, the cable attachment portion 92 may be easier to manufacture (e.g., require a simpler die that punches the terminals 40 from a sheet of metal) and provide sturdier wire positioners 98 that are better suited to withstand wire insertion forces.

It should be understood that the cable attachment portion 92 further includes a strip plated region 114 (e.g., a gold plated region). The strip plated region 114 can be provided by a continuous flow process. Preferably, the strip plated region 114 provides higher conductivity than the non-strip plated areas 116 of the cable attachment portion 92. The strip plated region 114 can be easily located based on the location of the wire positioners 98. In particular, the strip plated region 114 covers a sweet spot 118 of the cable attachment portion, e.g., at least a portion of the wire positioners 98 and part of the jaws 94 from the tops of the wire positioners 98 toward the end 110 of the cable attachment portion 92. Preferably, at least a portion of the sides 112 of the slot 96 includes strip plating as well.

Figure 6:
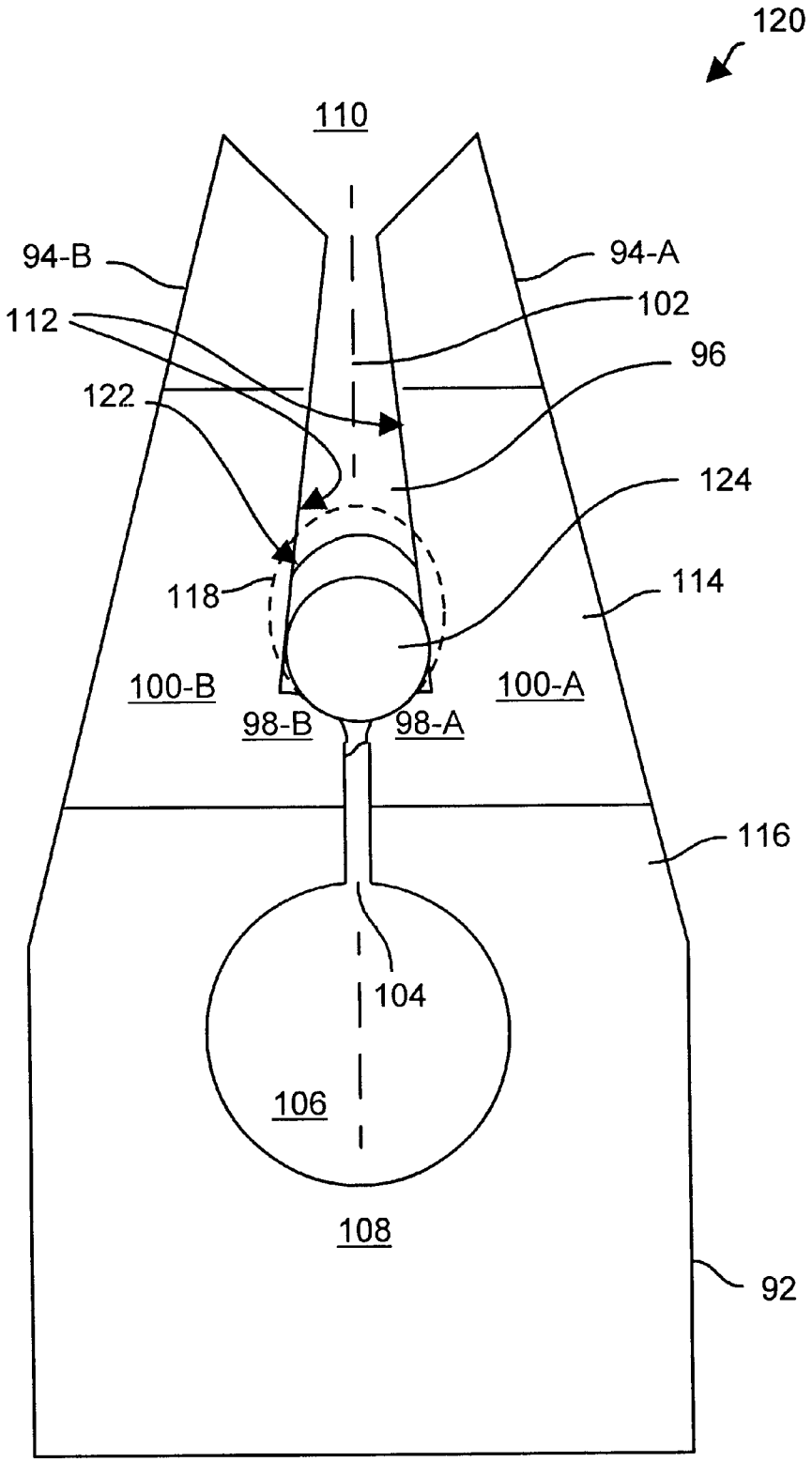
FIG. 6 is a side view of the alternative cable attachment portion of FIG. 5 when a wire having a solid conductor is installed.

FIG. 6 shows the cable attachment portion 92 and a cross-sectional view of a wire 122 having a single solid conductor 124 installed within the cable attachment portion 92 (rather than the stranded wire conductor 30 of FIG. 5). As shown, the cable attachment portion 92 contacts the conductor 124 in four different locations, i.e., by the jaw 94-A, the wire positioner 98-A, the wire positioner 98-B and the jaw 94-B. Accordingly, the cable attachment portion 92 (as well as the cable attachment portion 44, see FIG. 3) provides twice as many contact points as a convention IDC terminal having a rectangular-shaped slot (i.e., four contact points versus two in the conventional IDC terminal) for superior reliability and electrical connectivity.

Figure 7:
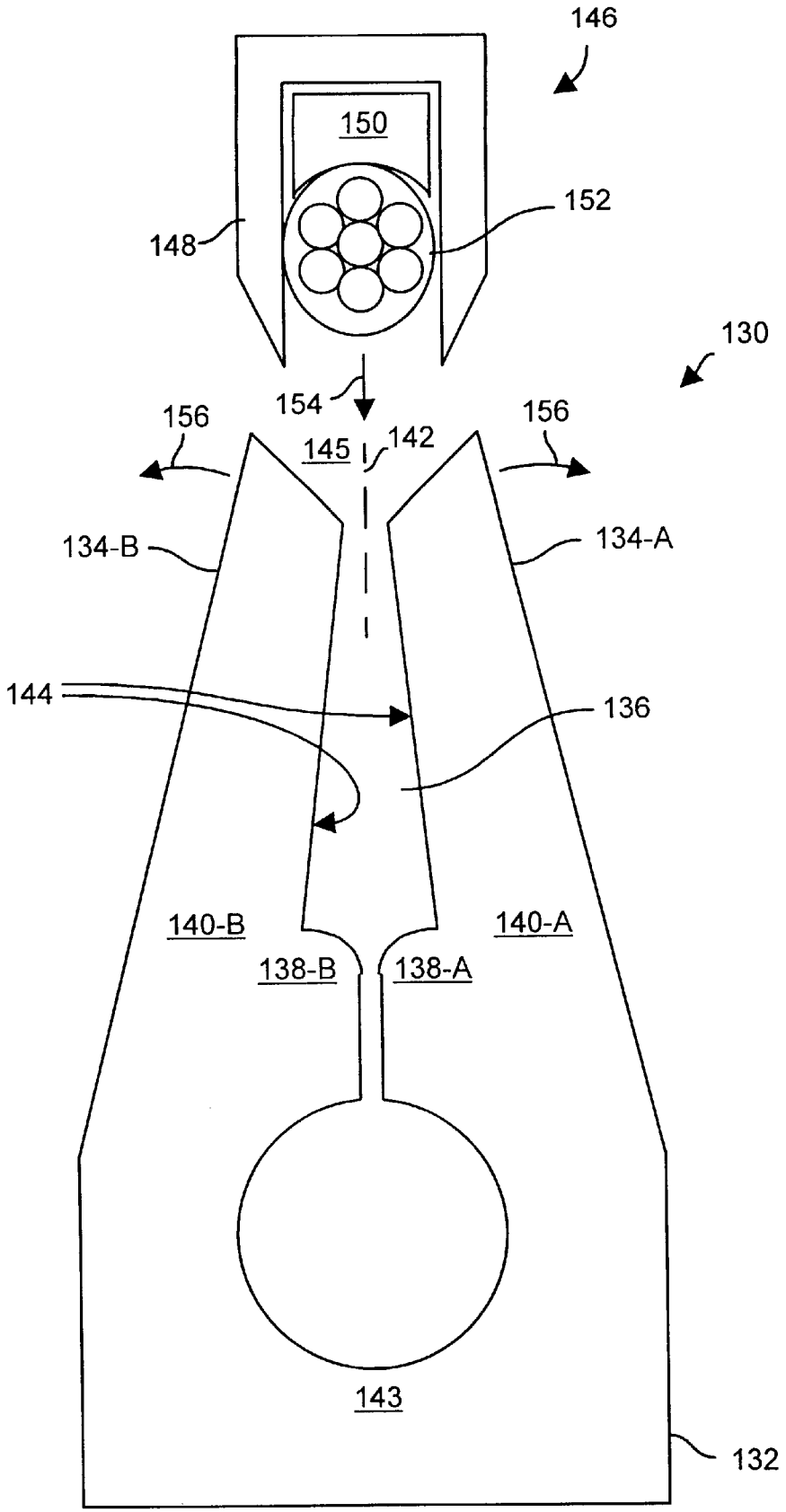
FIG. 7 is a side view of the alternative cable attachment portion of FIG. 5 and a cross-sectional side view of an installation assembly for installing a wire into the cable attachment portion.

FIG. 7 shows a side view of the cable attachment portion 132 and a wire installation assembly 146 which is capable of installing a wire into the cable attachment portion 132. The cable attachment portion 132 is similar to the cable attachment portion 92 of FIGS. 5 and 6 in that the cable attachment portion 132 defines jaws 134 that define a slot 136 and wire positioners 138 that extend from central locations 140 toward a midline 142 of the slot 136. The sides of the jaws 134 are such that the width of the slot 136 narrows in a direction from a mid-region 143 of the cable attachment portion 132 toward an end 145. The cable attachment portion 132 does not include strip plating.

The installation assembly 146 includes a spreader 148 which is capable of opening the jaws 134 of the cable attachment portion 132 in a direction 156 (see FIG. 7). Prior to installation, the spreader 148 pierces the wire insulation of the ribbon cable 22 (also see zones 37 in FIG. 1). At this point, the ends of the spreader 148 are now exposed and capable of engaging the cable attachment portion 132. In one arrangement, the spreader 148 needs to open the jaws 134 only by a few mils (a few thousandths of an inch) for proper wire insertion.

The installation assembly 146 further includes a feeder 150 that is capable of moving relative to the spreader 148. In particular, the feeder 150 moves out of the spreader 148, and pushes a wire 152 in a direction 154 toward the cable attachment portion 132 and into the slot 136 to a pre-set insertion depth. The feeder moves the wire 152 down the slot 136 and in contact with the wire positioners 138. At that point, the wire insulation has been displaced and the conductor 152 is exposed and in contact with the jaws 134.

In one arrangement, the feeder 150 is pneumatically actuated for precise control over the amount of force on the wire 152. When the installation assembly 146 is removed from the cable attachment portion 132, the jaws 134 close in a direction opposite the arrows 156 to constrain the wire 152. In another arrangement, the feeder 150 is spring-loaded (e.g., spring-loaded over-travel of a feeder arm). In yet another arrangement, the feeder 150 moves under operation of a computer monitored and controlled process having one or more pressure sensors to determine when to retract the feeder 150.

It should be understood that the spreader 148 and the feeder 150 are preferably capable of moving independently of each other. For example, the feeder 150 can hold the wire 152 against the wire positioners 138 while the spreader retracts thus allowing the jaws 134 to close around the wire 152 while the wire remains set against the wire positioners 138 with a controlled force. Such operation enables precise control over the jaw contact pressure on the wire 152.

Figure 8:
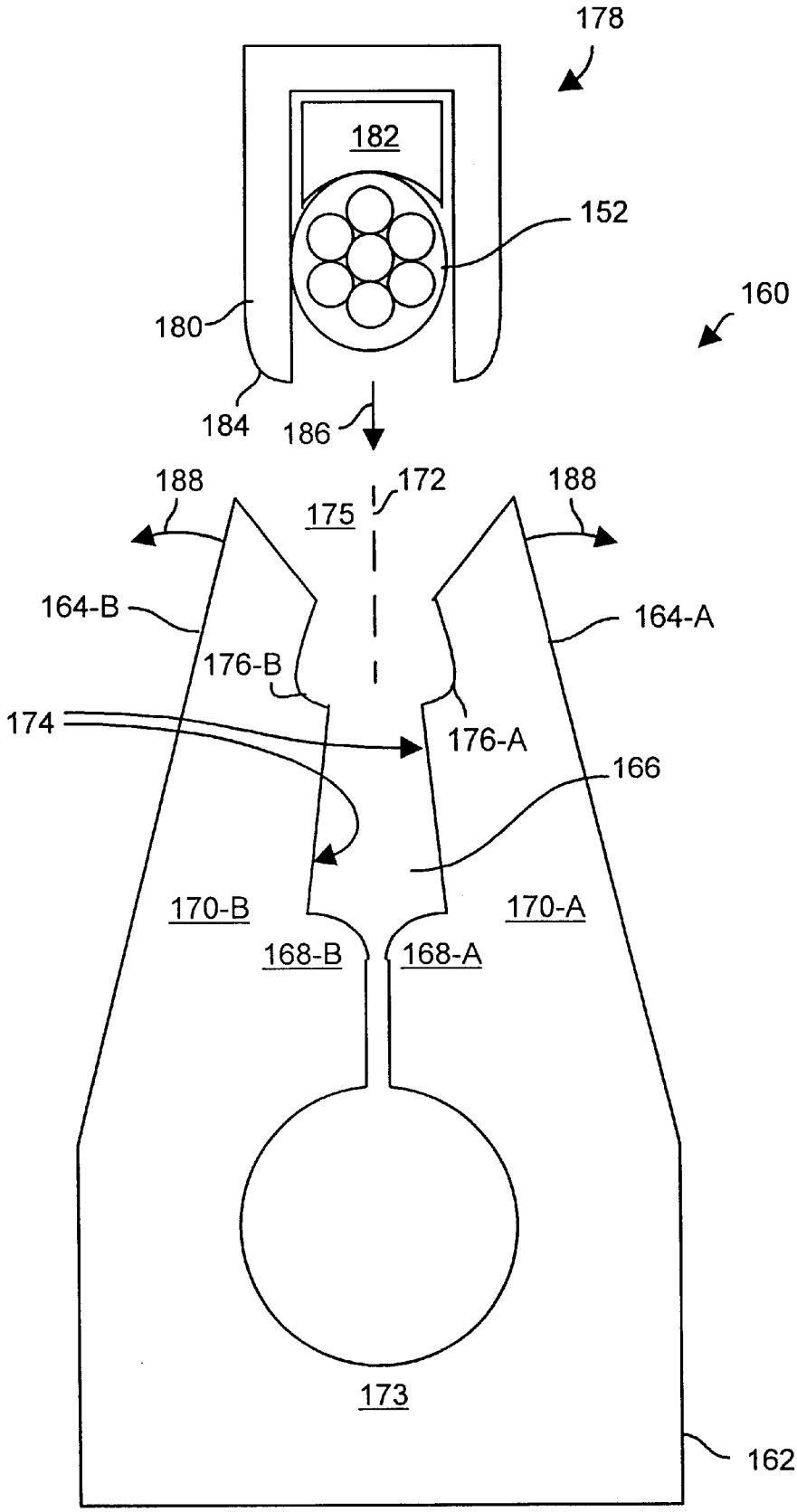
FIG. 8 is a side view of the alternative cable attachment portion of FIG. 5 and a cross-sectional side view of an alternative installation assembly to that of FIG. 7 for installing a wire into the cable attachment portion.

FIG. 8 shows a side view 160 of a cable attachment portion 162 which is suitable for use with the terminals 40 of FIG. 1. The cable attachment portion 162 is similar to the cable attachment portions 44, 92 and 132 in that the cable attachment portion 162 defines jaws 164 that define a slot 166 and wire positioners 168 that extend from central locations 170 toward a midline 172 of the slot 166. Furthermore, the sides 174 of the jaws 164 are such that the width of the slot 166 narrows in a direction from a mid-region 173 of the cable attachment portion 162 toward an end 175.

In contrast to the earlier-described cable attachment portions 44, 92 and 132, the jaws 164 of the cable attachment portion 162 define notches 176-A, 176-B. The notches 176-A, 176-B restrict the movement of a component of an installation assembly 178 (see FIG. 8). The installation assembly 178 is similar to the installation assembly 146 of FIG. 7 in that it includes a spreader 180 and a wire feeder 182. However, the spreader 180 defines rounded ends 184 which match the notches 176-A, 176-B defined by the jaws 164. Accordingly, when the spreader 180 moves in a direction 186 to open the jaws 164 in the directions 188, the spreader 180 is restricted from moving beyond the notches 176-A, 176-B. The feeder 182 is capable of moving in the direction 186 past the notches 176-A, 176-B to move the wire 152 into the slot 166 and in contact with the wire positioners 168 for proper wire placement. When the installation assembly 178 is removed, the jaws 164 close and the wire 152 is constrained within the slot 166, i.e., between the narrowing jaws 164 and the wire positioners 168.

Figure 9:
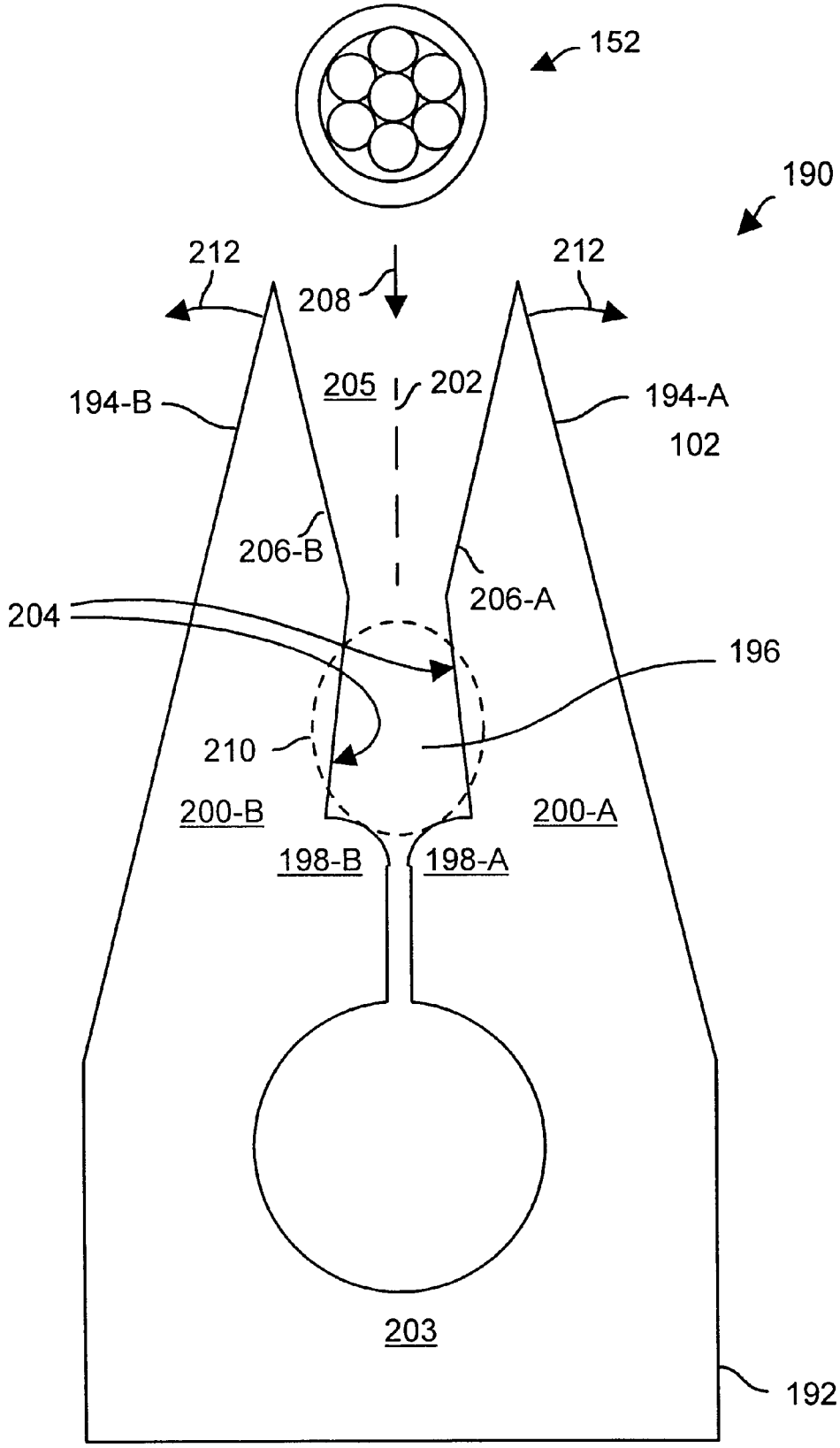
FIG. 9 is a side view of another alternative cable attachment portion which is suitable for receiving a wire without assistance of an installation assembly.

FIG. 9 is a side view 190 of another cable attachment portion 192 which is suitable for use by the terminals 40. The cable attachment portion 192 is similar to the cable attachment portions 44, 92, 132 and 162 in that the cable attachment portion 192 defines jaws 194 that define a slot 196 and wire positioners 198 that extend from central locations 200 toward a midline 202 of the slot 196. Additionally, the sides 204 of the jaws 164 are such that the width of the slot 196 narrows in a direction from a mid-region 203 of the cable attachment portion 192 toward an end 205.

In contrast to the earlier-described cable attachment portions 44, 92, 132 and 162, each jaw 194 of the cable attachment portion 192 defines a steep taper 206 to facilitate insertion of the wire 152 without the use of a spreader to open the jaws 194 (e.g., manually without the use of an installation assembly). As the wire 152 moves in the direction 208 toward the sweet spot 210 of the cable attachment portion 192, the wire 152 pushes the jaws 194 in an outward direction 212 thus opening the jaws in a hinge-like manner. In the case of installing ribbon cable onto a set of terminals 40, each having the cable attachment portion 192, the tapered jaws 194 pierce the insulation between the wires 152 of the ribbon cable (see zones 37 of FIG. 1). As the wire 152 moves further toward the sweet spot 204, the sides 204 of the jaws 194 cut the insulation of the wire 152 thus exposing the wire conductor and enabling the sides 204 to make direct electrical contact with the conductor. Each jaw 194 can have a tapered or narrowed edge (e.g., a blade or knife-like edge) to facilitate the insulation piercing and cutting process. When the wire reaches the sweet spot 210, the wire 152 is prohibited from moving further into the slot 196 by the wire positioners 198 and the jaws 194 close around the wire 152. Accordingly, the wire positioners 198 and the jaws 194 provide a constraint that prevents the wire 152, or parts of the wire 152 (e.g., strands), from straying from the sweet spot 210. As a result, the cable attachment portion 192 provides a correct amount of pressure on the wire 152 for optimal electrical connectivity and reliability.

As described above, the invention is directed to techniques for forming an insulation displacement connection using a terminal 40 that defines wire positioners which can precisely locate a wire within the terminal 40. The wire positioners facilitate wire retention and improve electrical connectivity thus providing a reliable electrical pathway between the wire and the terminal 40. The features of the invention, as described above, may be employed in computer systems, components and procedures as well as other electronic devices such as those provided by EMC Corporation of Hopkinton, Mass.

While this invention has been particularly shown and described with references to preferred embodiments thereof, it will be understood by those skilled in the art that various changes in form and details may be made therein without departing from the spirit and scope of the invention as defined by the appended claims.

For example, the base portions of the terminals 40 were described as pins by way of example only. The base portions can have other configurations as well such as pad configurations, contacts, crimps, etc.

Additionally, the ribbon cable assembly 20 was described above as being suitable for use in connecting components such as a disk drive and a disk drive controller together by way of example only. The ribbon cable assembly 20 can be used to connect other types of electronic devices such as circuit boards (e.g., processor boards, memory boards, network interface boards, etc.). Furthermore, such an assembly can be used to carry individual unrelated signals, parallel signals (e.g., bus signals such as data, address and control signals), and so on.

Furthermore, it should be understood that the cable attachment portion 44 of FIG. 5 was described above as including strip plating to improve electrical conductivity. Any of the above-described cable attachment portions can include such strip plating. Such strip plating enables increased electrical conductivity but does not waste material by applying it over the entire terminal 40. Materials which are suitable for strip plating include highly conductive (i.e., low resistance) and/or non-corroding metals such as bronze, brass, gold, and other noble metals (e.g., Palladium). Other soft metals can be used in the strip plating area as well such as tin, lead, etc. It should be understood that most base metals or alloys can be locally overplated with a noble metal. In some situations, this requires an underplate suitable for the base metal.

Additionally, it should be understood that the connector 24 of FIG. 1 was described as including only a singly row of terminals 40 by way of example only. Other configurations are suitable for use as well such as multiple rows of terminals, independently positioned and irregular configurations, application specific configurations, etc.

Furthermore, it should be understood that the IDC terminals 40 were described above as being scaled for a ribbon cable connector 24 (see FIG. 1). It should be understood that the IDC terminals 40 can be sized to a different scale (e.g., a larger scale) for application other than ribbon cables. For example, terminals for larger scale items such as wall plugs and wall switches can include terminals having cable attachment portions similar to that shown in the figures. Such terminals need not provide an IDC feature but can include the above-described geometries in order to provide constraint on pre-stripped wires which is superior to conventional terminals (e.g., conventional terminals having rectangular-shaped slots, conventional terminals which require a person to screw down wires, etc.). Such modifications and enhancements are intended to be part of embodiments of the invention.

What is claimed is:

1. An insulation displacement connection terminal, comprising:

a base portion for coupling to an external device; and a cable attachment portion, which is unitary with the base portion, including jaws that define:

(i) a slot having a slot opening region, a narrow slot region and a wide slot region, and (ii) wire positioners, wherein the narrow slot region and the wide slot region are disposed between the slot opening region and the base portion, wherein the wide slot region is disposed between the narrow slot region and the base portion, wherein the wire positioners are disposed between the wide slot region and the base portion, and wherein the jaws are configured to receive a wire through the slot opening region and the narrow slot region and retain the wire within the wide slot region.

2. The insulation displacement connection terminal of claim 1 wherein the cable attachment portion defines a substantially circular opening at a centrally disposed end of the slot, and wherein the substantially circular opening has a diameter which is greater than that of the wide slot region of the slot.

3. The insulation displacement connection terminal of claim 1, further comprising:

a high-conductive metallic coating disposed over wire positioner surfaces of the wire positioners such that the wire positioner surfaces have higher electrical conductivity than surfaces of the base portion.

4. The insulation displacement connection terminal of claim 1 wherein the jaws further define an opening disposed between the slot and the base portion, and wherein each wire positioner extends from a central region of a jaw toward a midline of the slot to provide a physical barrier between the wide slot region and the opening which inhibits the wire from moving from the wide slot region into the opening.

5. The insulation displacement connection terminal of claim 4 wherein the jaws of the cable attachment portion are configured to retain a wire having seven strands, each strand having a diameter N; and wherein the jaws of the cable attachment portion further define a gap between the wire positioners that is substantially half of the diameter N.

6. The insulation displacement connection terminal of claim 1 wherein, when the wire resides within the wide slot region, the jaws of the cable attachment portion provide a taper to the slot such that the narrow slot region has a width which is narrower than that of the wide slot region to inhibit movement of the wire from the wide slot region through the narrow slot region toward the slot opening region.

7. The insulation displacement connection terminal of claim 6 wherein, when the wire is retained within the wide slot region, the jaws define sides of the wide slot region which are substantially non-parallel to each other.

8. An insulation displacement connection connector, comprising:

a connector housing; and a set of terminals supported by the connector housing, each terminal having a base portion for coupling to an external device, and a cable attachment portion which is unitary with the base portion of that terminal, wherein the cable attachment portion of each terminal includes jaws that define:

(i) a slot having a slot opening region, a narrow slot region and a wide slot region, and (ii) wire positioners, wherein the narrow slot region and the wide slot region are disposed between the slot opening and the base portion, wherein the wide slot region is disposed between the narrow slot region and the base portion, wherein the wire positioners are disposed between the wide slot region and the base portion, and wherein the jaws are configured to receive a wire through the slot opening region and the narrow slot region and retain the wire within the wide slot region.

9. The insulation displacement connection connector of claim 8 wherein the cable attachment portion of each terminal defines a substantially circular opening at a centrally disposed end of the slot defined by the cable attachment portion of that terminal, and wherein the substantially circular opening has a diameter which is greater than the wide slot region of the slot defined by the jaws of the cable attachment portion of that terminal.

10. The insulation displacement connection connector of claim 8, further comprising:

a high-conductive metallic coating disposed over wire positioner surfaces of the wire positioners such that the wire positioner surfaces have higher electrical conductivity than surfaces of the base portions.

11. The insulation displacement connection connector of claim 8 wherein the jaws of each terminal further define an opening disposed between the slot and the base portion of that terminal, and wherein the wire positioners defined by the jaws of the cable attachment portion of each terminal extend from central regions of the jaws of the cable attachment portion of that terminal toward a midline of the slot defined by the jaws of the cable attachment portion of that terminal to provide physical barriers between the wide slot region and the opening which inhibit wire movement from the wide slot region into the opening.

12. The insulation displacement connection connector of claim 11 wherein the jaws of the cable attachment portion of each terminal are configured to retain a wire having seven strands, each strand having a diameter N; and wherein the jaws of the cable attachment portion of each terminal further define a gap between the wire positioners, the gap being substantially half of the diameter N.

13. The insulation displacement connection connector of claim 8 wherein, for each terminal, when the wire resides within the wide slot region of the slot defined by the jaws of that terminal, the jaws of the cable attachment portion provide a taper to the slot such that the narrow slot region has a width which is narrower than that of the wide slot region to inhibit movement of the wire from the wide slot region through the narrow slot region toward the slot opening region.

14. The insulation displacement connection connector of claim 13 wherein, for each terminal, when the wire is retained within the wide slot region of the slot defined by the jaws of that terminal, the jaws define sides of the wide slot region which are substantially non-parallel to each other.

15. A ribbon cable assembly, comprising:

a segment of ribbon cable having a first end and a second end;

a first insulation displacement connection connector mounted to the first end of the segment of ribbon cable; and a second insulation displacement connection connector mounted to the second end of the segment of ribbon cable, each of the first and second insulation displacement connection connectors including:

a connector housing, and a set of terminals supported by the connector housing, each terminal having a base portion for coupling to an external device, and a cable attachment portion which is unitary with the base portion of that terminal, wherein the cable attachment portion of each terminal includes jaws that define:

(i) a slot having a slot opening region, a narrow slot region and a wide slot region, and (ii) wire positioners, wherein the narrow slot region and the wide slot region are disposed between the slot opening and the base portion, wherein the wide slot region is disposed between the narrow slot region and the base portion, wherein the wire positioners are disposed between the wide slot region and the base portion, and wherein the jaws are configured to receive a wire through the slot opening region and the narrow slot region and retain the wire within the wide slot region.

16. The ribbon cable assembly of claim 15 wherein the cable attachment portion of each terminal defines a substantially circular opening at a centrally disposed end of the slot defined by the cable attachment portion of that terminal, and wherein the substantially circular opening has a diameter which is greater than the wide slot region defined by the jaws of the cable attachment portion of that terminal.

17. The ribbon cable assembly of claim 15, further comprising:

a high-conductive metallic coating disposed over wire positioner surfaces of the wire positioners such that the wire positioner surfaces have higher electrical conductivity than surfaces of the base portions.

18. The ribbon cable assembly of claim 15 wherein the jaws further define an opening disposed between the slot and the base portion of that terminal, and wherein the wire positioners defined by the jaws of the cable attachment portion of each terminal extend from central regions of the jaws of the cable attachment portion of that terminal toward a midline of the slot defined by the jaws of the cable attachment portion of that terminal to provide physical barriers between the wide slot region and the opening which inhibit wire movement from the wide slot region into the opening.

19. The ribbon cable assembly of claim 18 wherein the jaws of the cable attachment portion of each terminal are configured to retain a wire having seven strands, each strand having a diameter N; and wherein the jaws of the cable attachment portion of each terminal further define a gap between the wire positioners, the gap being substantially half of the diameter N.

20. The ribbon cable assembly of claim 15 wherein, for each terminal, when the wire resides within the wide slot region defined by the jaws of that terminal, the jaws of the cable attachment portion provide a taper to the slot such that the narrow slot region has a width which is narrower than that of the wide slot region to inhibit movement of the wire from the wide slot region through the narrow slot region toward the slot opening region.

21. The ribbon cable assembly of claim 20 wherein, for each terminal, when the wire is retained within the wide slot region of the slot defined by that terminal, the jaws define sides of the wide slot region which are substantially non-parallel to each other.

22. A method for forming an insulation displacement connection between a ribbon cable and an insulation displacement connection connector, the method comprising the steps of:

positioning the ribbon cable adjacent a set of terminals of the insulation displacement connection connector;

moving the ribbon cable and the set of terminals in a direction toward each other such that a slot defined by each terminal receives a wire of the ribbon cable, wherein the slot of each terminal has a slot opening region, a narrow slot region and a wide slot region, wherein the narrow slot region and the wide slot region are disposed between the slot opening region and a base portion of that terminal, wherein the wide slot region is disposed between the narrow slot region and the base portion of that terminal, and wherein that terminal receives the wire of the ribbon cable through the slot opening and the narrow slot region and retains that wire within the wide slot region; and preventing the ribbon cable from further moving in the direction when the wire received in the slot of each terminal interferes with wire positioners defined by that terminal.

23. The method of claim 22 wherein each terminal includes a pair of jaws that define the wire positioners for that terminal, wherein the wire positioners defined by each terminal extend from central regions of the jaws of that terminal toward a midline of the slot defined by that terminal, and wherein the method further comprises the step of:

opening the jaws of each terminal prior to moving the ribbon cable and the set of terminals in a direction toward each other.

* * * * *